US011069993B2

(12) United States Patent
Takaki

(10) Patent No.: US 11,069,993 B2
(45) Date of Patent: Jul. 20, 2021

(54) MOUNTING STRUCTURE OF CONNECTOR SHIELD

(71) Applicant: DENSO TEN Limited, Kobe (JP)

(72) Inventor: Toshiaki Takaki, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 16/813,985

(22) Filed: Mar. 10, 2020

(65) Prior Publication Data

US 2021/0028565 A1 Jan. 28, 2021

(30) Foreign Application Priority Data

Jul. 24, 2019 (JP) ..... JP2019-136431

(51) Int. Cl.

| | |
|---|---|
| ***H01R 12/71*** | (2011.01) |
| ***H01R 12/70*** | (2011.01) |
| ***H01R 13/639*** | (2006.01) |
| ***H01R 13/6594*** | (2011.01) |
| ***H01R 13/6582*** | (2011.01) |

(52) U.S. Cl.

CPC ..... *H01R 12/71* (2013.01); *H01R 12/7005* (2013.01); *H01R 13/639* (2013.01); *H01R 13/6582* (2013.01); *H01R 13/6594* (2013.01)

(58) Field of Classification Search

CPC .. H01R 12/71; H01R 12/7005; H01R 13/639; H01R 13/6582; H01R 13/6594

USPC ..... 439/78

See application file for complete search history.

(56) References Cited

U.S. PATENT DOCUMENTS

| | | | | | |
|---|---|---|---|---|---|
| 5,017,156 | A * | 5/1991 | Sugiyama | H01R 13/6582 | 439/607.32 |
| 5,073,130 | A * | 12/1991 | Nakamura | H01R 13/6582 | 439/607.32 |
| 5,221,212 | A * | 6/1993 | Davis | H01R 12/724 | 439/108 |
| 5,984,725 | A * | 11/1999 | Belopolsky | H01R 13/7195 | 439/607.31 |
| 6,007,381 | A * | 12/1999 | Ando | H01R 12/7064 | 439/607.01 |
| 6,083,043 | A * | 7/2000 | Lok | H01R 12/7064 | 439/567 |
| 6,364,700 | B1 * | 4/2002 | Zhu | H01R 12/7023 | 439/567 |

(Continued)

FOREIGN PATENT DOCUMENTS

| | | |
|---|---|---|
| JP | H08-339861 A | 12/1996 |
| JP | 2009-238621 A | 10/2009 |

(Continued)

*Primary Examiner* — Peter G Leigh
(74) *Attorney, Agent, or Firm* — Oliff PLC

(57) ABSTRACT

In the mounting structure of the connector shield, the connector shield includes an upper plate, a pair of side plates, and a mounting portion provided on a lower edge side of each of the side plates, and the mounting portion includes a retainer that includes a foot protruding downward from a first position of a lower edge of the side plate, and a locking hook protruding forward or rearward from the foot in a first direction, and a positioning protrusion that protrudes downward from a second position shifted from the first position of the lower edge of the side plate in a second direction opposite to the first direction.

3 Claims, 15 Drawing Sheets

(56) References Cited

U.S. PATENT DOCUMENTS 6,394,846 B1 * 5/2002 Belopolsky ..... H01R 13/7195 439/620.11
6,416,361 B1 * 7/2002 Hwang ..... H01R 13/6594 439/607.2
6,419,523 B1 * 7/2002 Jones ..... H05K 3/301 439/607.2
6,612,868 B2 * 9/2003 Hwang ..... H05K 9/0058 439/607.54
6,672,901 B2 * 1/2004 Schulz ..... H05K 3/301 439/607.35
7,727,019 B2 * 6/2010 Droesbeke ..... H01R 13/6594 439/607.35
7,771,235 B2 * 8/2010 Kameyama ..... H01R 13/648 439/607.27
8,109,791 B2 * 2/2012 Kameyama ..... H01R 23/6873 439/607.37
8,360,808 B2 * 1/2013 Tsuchiya ..... H01R 12/724 439/607.55
8,435,075 B2 * 5/2013 Lim ..... H01R 12/724 439/607.35
8,848,387 B2 * 9/2014 Nagata ..... H01R 13/6594 361/767
8,968,031 B2 * 3/2015 Simmel ..... H01R 13/6594 439/660
9,397,447 B2 * 7/2016 Karachi ..... H01R 13/04
9,425,542 B1 * 8/2016 Wu ..... H01R 13/521
9,887,472 B2 * 2/2018 Park ..... H01R 12/7076
9,960,552 B2 * 5/2018 Tsai ..... H01R 13/6585
10,128,596 B2 * 11/2018 Tsai ..... H01R 13/516
10,348,035 B1 * 7/2019 Kato ..... H01R 27/02

FOREIGN PATENT DOCUMENTS

JP 2016-081591 A 5/2016
JP 2019-016514 A 1/2019

* cited by examiner

MOUNTING STRUCTURE OF CONNECTOR SHIELD

CROSS-REFERENCE TO RELATED APPLICATIONS

This application is based upon and claims the benefit of prior Japanese Patent Applications No. 2019-136431 filed on Jul. 24, 2019, the entire contents of which are incorporated herein by reference.

FIELD

The present invention relates to a mounting structure of a connector shield.

BACKGROUND

To electromagnetically shield a connector provided in a wiring board of electronic equipment or the like, it is a common practice to dispose a connector shield to cover an outer periphery of the connector (e.g., see Patent documents 1 to 4). To mount the connector shield to the wiring board, the shield is often fixed together with the connector by soldering in a dip system, and in recent years, the connector has been fixed to the wiring board in a reflow system in an increasing number of cases. Consequently, there are increasing needs for the fixing of the connector shield to the wiring board by a method other than the soldering in the dip system to inhibit complication of a manufacturing process of the electronic equipment and suppress increase of a number of steps. Examples of a fixing method in place of the soldering in the dip system include claw bend fixing and screwing (fastening) fixing.

The claw bend fixing of the connector shield includes inserting a locking claw of the connector shield into a through hole formed in the wiring board, then bending the locking claw with a pair of pliers on a rear surface side of the wiring board, and locking the locking claw in the wiring board to thereby fix the connector shield. The screw fixing of the connector shield includes fixing the connector shield to the wiring board by use of screws.

[Patent document 1] Japanese Patent Laid-Open No. 2009-238621

[Patent document 2] Japanese Patent Laid-Open No. 2016-081591

[Patent document 3] Japanese Patent Laid-Open No. 2019-016514

[Patent document 4] Japanese Patent Laid-Open No. 1996-339861

SUMMARY

Technical Problem

In the above claw bend fixing, however, a locking claw rubs against a wiring board when bending the locking claw, and hence foreign matter such as board chippings might be generated. Furthermore, a facility and a process are required to bend the locking claw, and cost for fixing a connector shield to the wiring board is likely to increase. Furthermore, in the wiring board, an electronic component cannot be mounted in an operation region of a jig to bend the locking claw, and hence a position, region and the like to mount the electronic component may be restricted.

Therefore, it is conceivable to use a screw fixing system that does not cause any of the above disadvantages. However, the conventional screw fixing system has the following problems. That is, in case where an earth spring to acquire electrical continuity is interposed between an upper surface of a connector and the connector shield in the conventional screw fixing system, the connector shield is urged in a rising direction due to a repulsive force of the earth spring. Consequently, after the connector shield is attached to the wiring board, it is necessary to press the connector shield onto the wiring board, for example, with a jig during screwing.

Furthermore, if the connector shield is fixed to the wiring board and then the connector shield is raised due to repulsive force of the earth spring, the electrical continuity between the connector shield and the connector becomes unstable. To suppress this, the connector shield needs to be screwed to the wiring board, for example, in at least two positions on opposite sides of the connector. However, if a large number of connectors are arranged on the wiring board, there is case where a screw fixing space cannot be sufficiently acquired on the wiring board.

An object of the present invention is to provide a technology concerning a connector shield mounting structure that is capable of easily mounting, to a wiring board, a connector shield including an earth spring interposed between an upper surface of a connector and the connector shield, and that is additionally capable of acquiring electrical continuity between the connector shield and the connector only with one screw position to the wiring board.

Solution to Problem

According to the present invention, provided is a mounting structure of a connector shield mounted on a wiring board and configured to cover a connector including a port for a mating connector in a front surface of the connector, the connector shield includes an upper plate that covers an upper surface of the connector, and a pair of side plates that cover side surfaces of the connector, and extend downward from opposite side ends of the upper plate, and a mounting portion provided on a lower edge side of each of the side plates, to mount each side plate to the wiring board, the wiring board includes a slit through hole to position and fix the mounting portion of each side plate, an earth spring is interposed between the connector shield and the connector, the mounting portion includes a retainer that includes a foot protruding downward from a first position of a lower edge of the side plate, and a locking hook protruding forward or rearward from the foot in a first direction and that is insertable into the slit through hole, and a positioning protrusion that protrudes downward from a second position shifted from the first position of the lower edge of the side plate in a second direction opposite to the first direction and that is insertable into the slit through hole, and the locking hook inserted into the slit through hole is locked in an edge portion of the slit through hole, and the positioning protrusion and the foot inserted into the slit through hole engage with a hole wall surface of the slit through hole, so that the mounting portion is positioned and fixed to the slit through hole.

Advantageous Effects of Invention

According to the present invention, a connector shield mounting structure can be provided that is capable of easily mounting, to a wiring board, a connector shield including an earth spring interposed between an upper surface of a connector and the connector shield, and that is additionally capable of acquiring electrical continuity between the connector shield and the connector only with one screw position to the wiring board.

BRIEF DESCRIPTION OF THE DRWINGS

DESCRIPTION OF EMBODIMENTS

Hereinafter, description will be made as to embodiments of the present invention with reference to the drawings.

Embodiment 1

Figure 1:
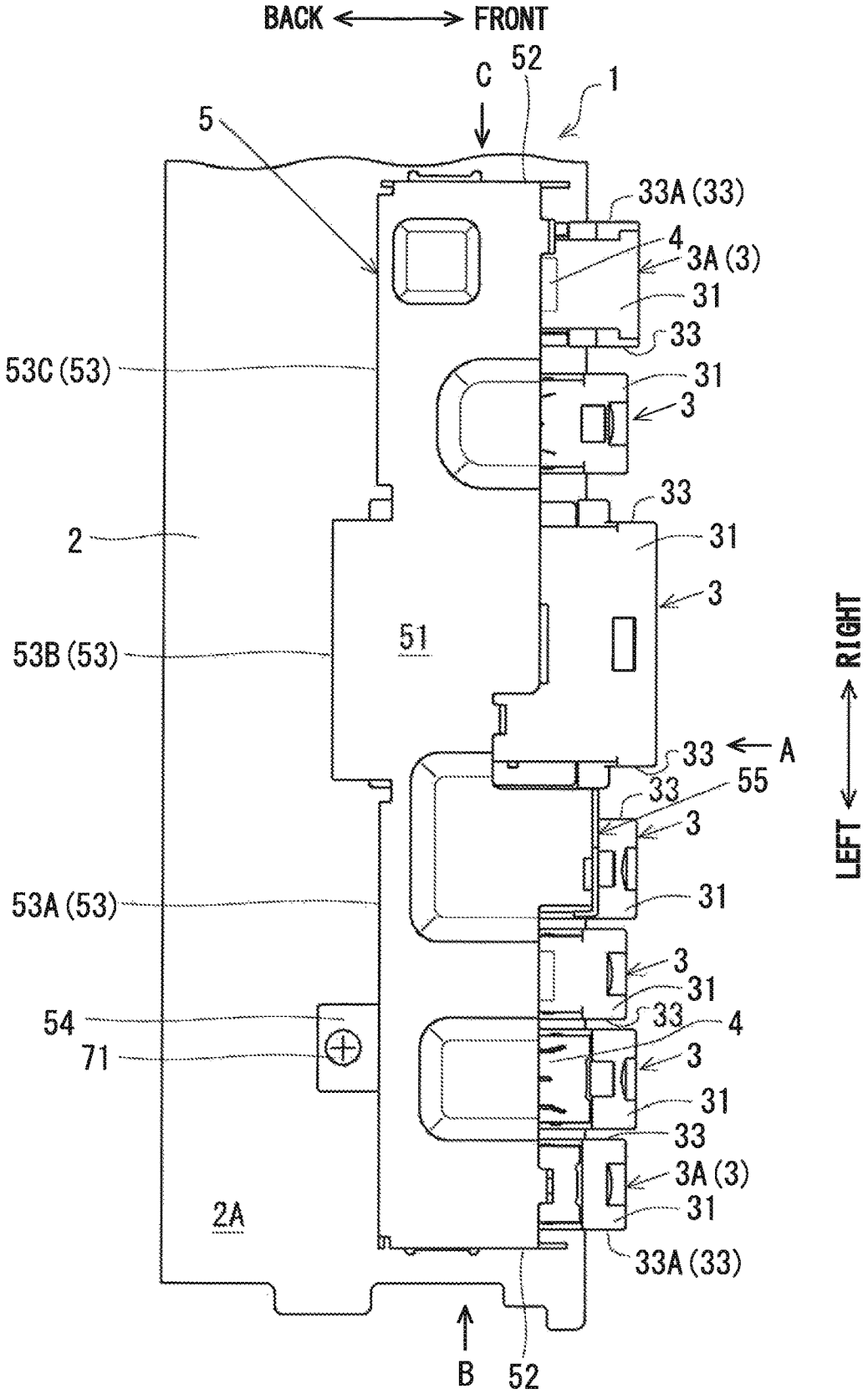
FIG. 1 is a top view of a mounting structure of a connector shield according to Embodiment 1.
Figure 2:
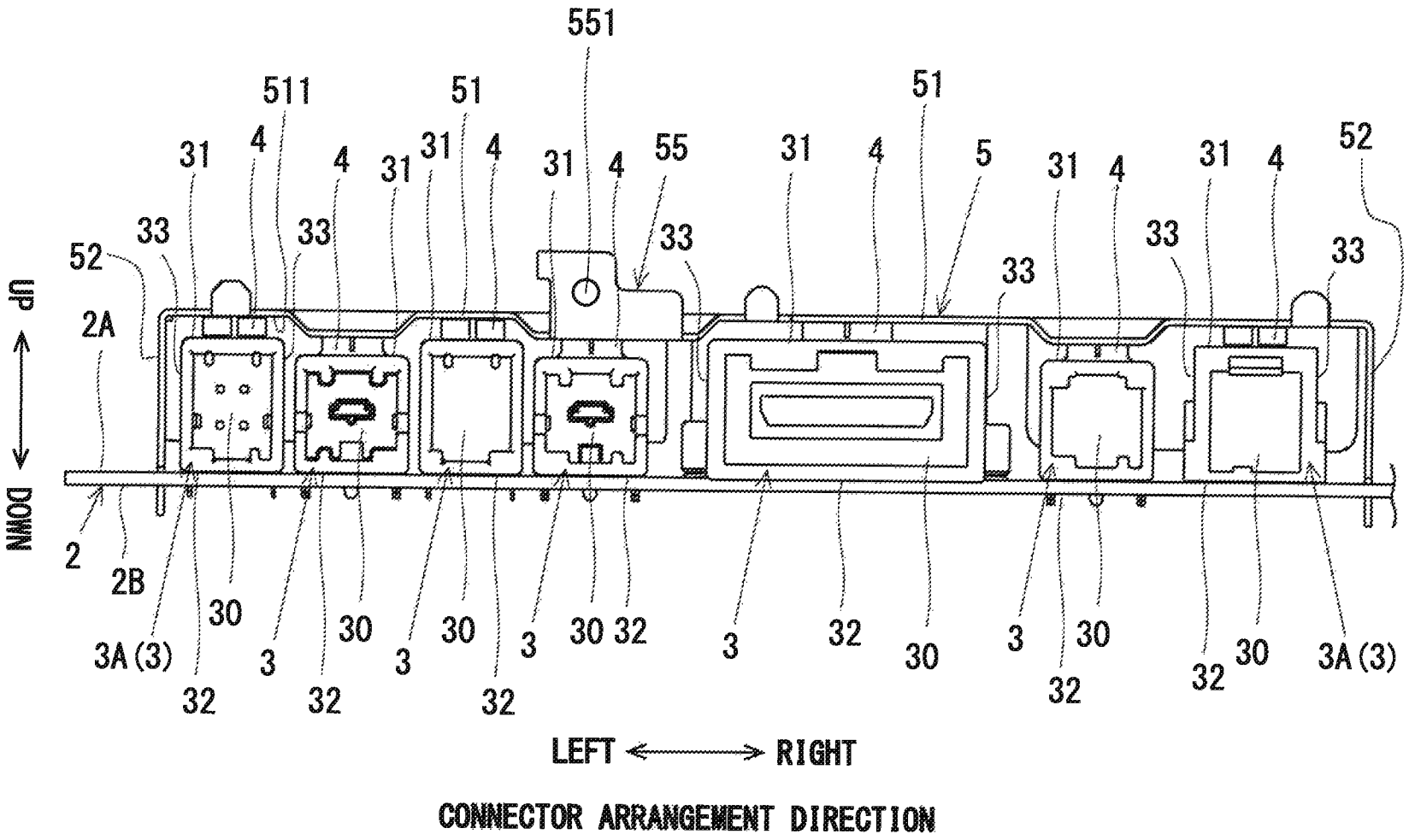
FIG. 2 is a front view of the mounting structure of the connector shield according to Embodiment 1.
Figure 3:
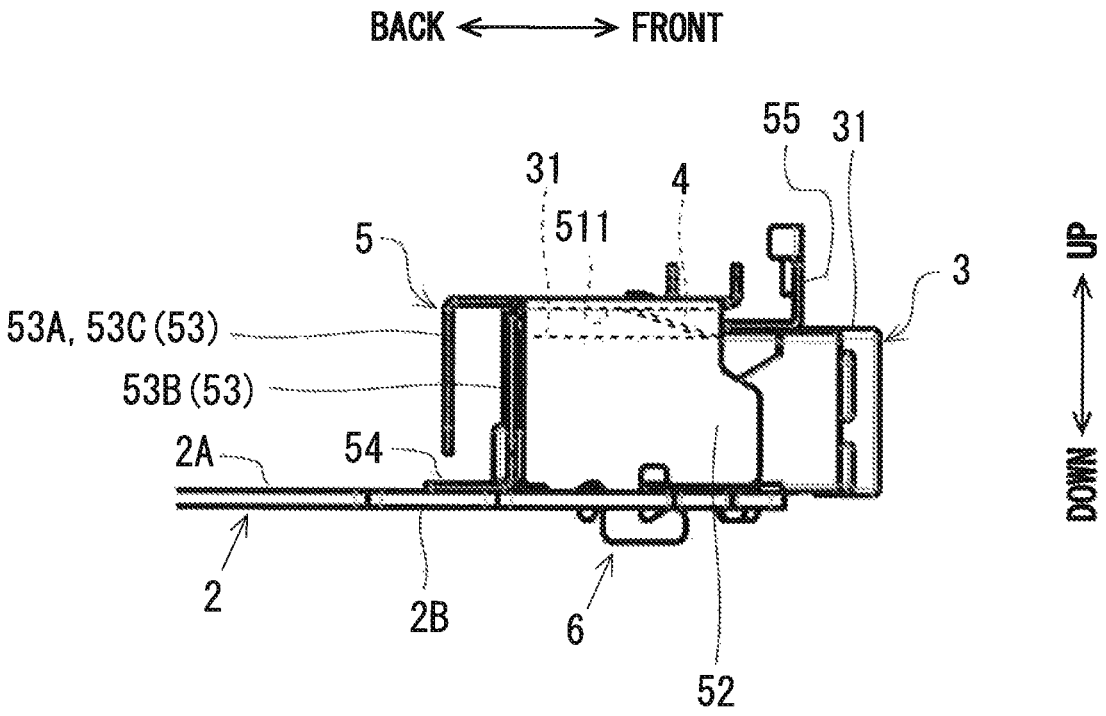
FIG. 3 is a left side view of the mounting structure of the connector shield according to Embodiment 1.
Figure 4:
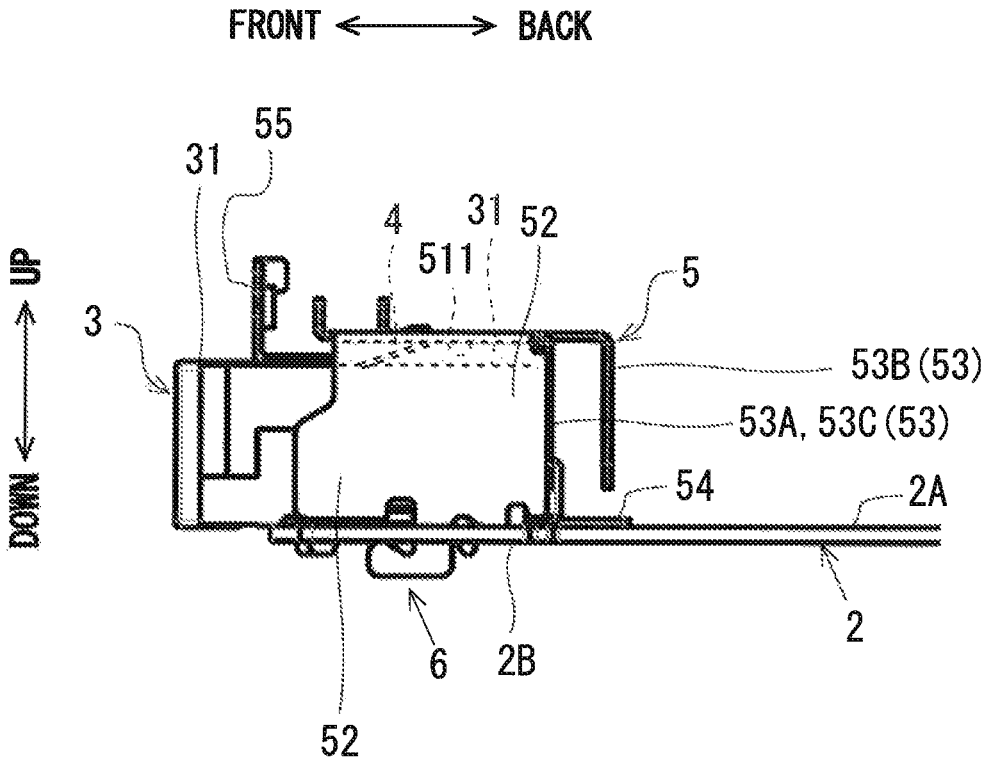
FIG. 4 is a right side view of the mounting structure of the connector shield according to Embodiment 1.

FIG. 1 is a top view of a mounting structure 1 of a connector shield according to Embodiment 1. FIG. 2 is a front view of the mounting structure 1 of the connector shield according to Embodiment 1, and is a view from an arrow A in FIG. 1. FIG. 3 is a left side view of the mounting structure 1 of the connector shield according to Embodiment 1, and is a view from an arrow B in FIG. 1. FIG. 4 is a right side view of the mounting structure 1 of the connector shield according to Embodiment 1, and is a view from an arrow C in FIG. 1.

Reference numeral 2 denotes a wiring board housed, for example, in a housing (casing) made of a metal for electronic equipment, and a plurality of connectors 3 mounted on an upper surface 2A of the board are arranged side by side. In an example illustrated in FIG. 1 to FIG. 4, a part of the wiring board 2 is only illustrated. Furthermore, in the example illustrated in FIG. 1 and FIG. 2, seven connectors 3 are arranged on the upper surface 2A of the wiring board 2. Note that reference symbol 2B denotes a lower surface of the wiring board 2.

The wiring board 2 is, for example, a printed circuit board (PCB), but is not particularly limited. Furthermore, each of the connectors 3 mounted on the upper surface 2A of the wiring board 2 is soldered to the wiring board 2, for example, by a reflow system. Additionally, each connector 3 includes a port 30 into which a mating connector (not illustrated) is insertable.

In the following, for convenience of explanation, it is considered that a direction vertical to the wiring board 2 is an up-down direction, a direction in which the mating connector is inserted into the connector 3 is a front-back direction, and a direction perpendicular to the up-down direction and the front-back direction is a right-left direction (a lateral direction). Furthermore, the respective up-down, front-back and right-left directions for use herein merely indicate a relative positional relation between respective components in describing the mounting structure 1 of the connector shield.

Each of the connectors 3 is formed in a box shape, and includes an upper wall 31 as an upper surface, a lower wall 32 as a lower surface, side walls 33 as a pair of (right and left) side surfaces, and a rear wall 34 as a rear surface. The connector 3 is capable of receiving the mating connector in a housing space surrounded with the upper wall 31, the lower wall 32 and the pair of side walls 33, and an opening formed in a front end of each of these walls functions as the port 30. In the housing space of the connector 3, for example, a connection terminal electrically connected to a wire formed in the wiring board 2 is disposed. The mating connector is inserted from the port 30 of the front surface in the connector 3, and a terminal of the connector 3 is electrically connected to a terminal of the mating connector. Note that the upper wall 31, the lower wall 32, the side walls 33 and the rear wall 34 of the connector 3 form the metal-made connector housing.

Reference numeral 5 illustrated in FIG. 1 to FIG. 4 denotes a connector shield that covers an outer surface of the connector 3 to electromagnetically shield the connector 3. The connector shield 5 is inserted and fixed through the wiring board 2 and the metal-made housing, and inhibits noise generated in an electronic component (not illustrated) mounted in the wiring board 2 from being transmitted to outside via the connector 3.

Figure 5:
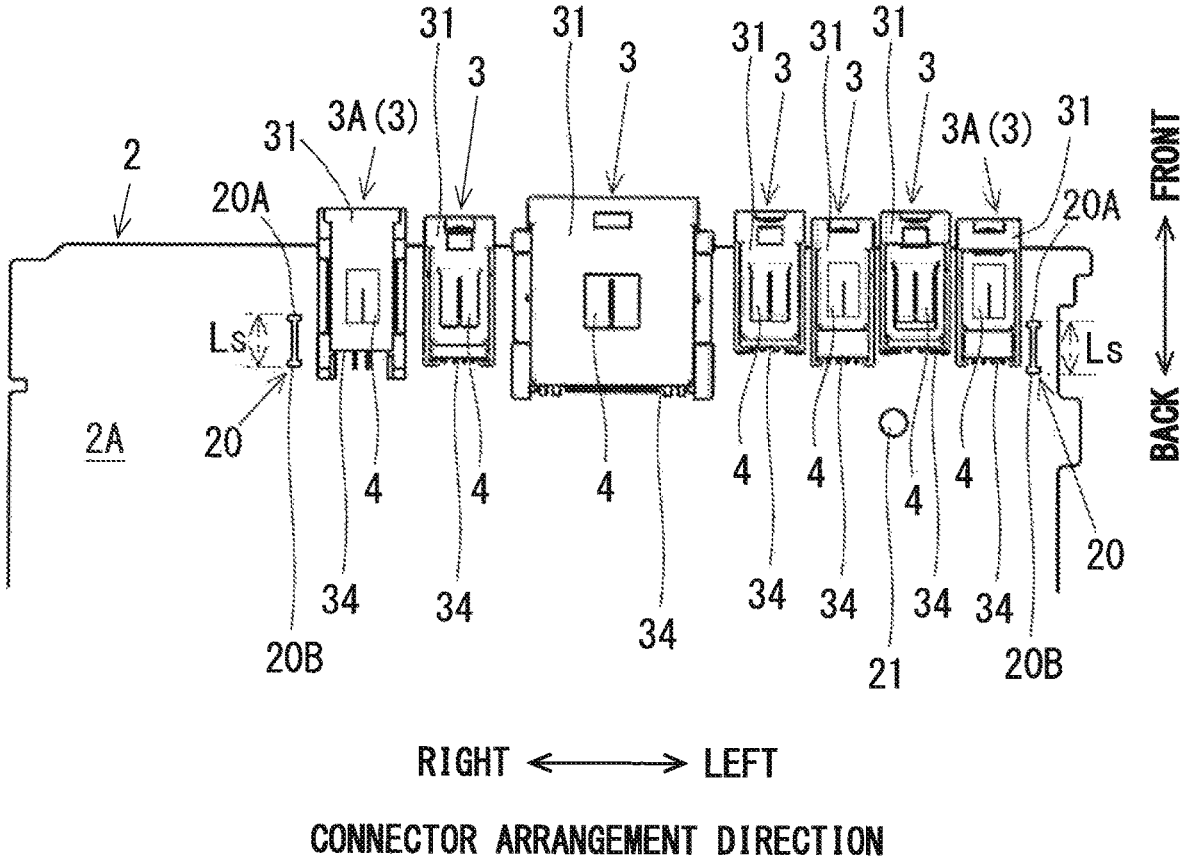
FIG. 5 is a top view of a connector mounted in a wiring board according to Embodiment 1.

In the present embodiment, the connector shield 5 is provided to cover the outer surface of the connector 3 located on a rear side from near a central portion of the connector 3 in the front-back direction. FIG. 5 is a top view of the connector 3 mounted in the wiring board 2 according to Embodiment 1, and illustrates a state before the connector shield 5 is disposed. On the other hand, FIG. 1 to FIG. 4 illustrate a state where the connector shield 5 is fixed to the wiring board 2. Furthermore, FIG. 1, FIG. 2, FIG. 5 and others omit notation of reference numerals of the side walls 33 and others in some of the connectors 3.

Figure 6:
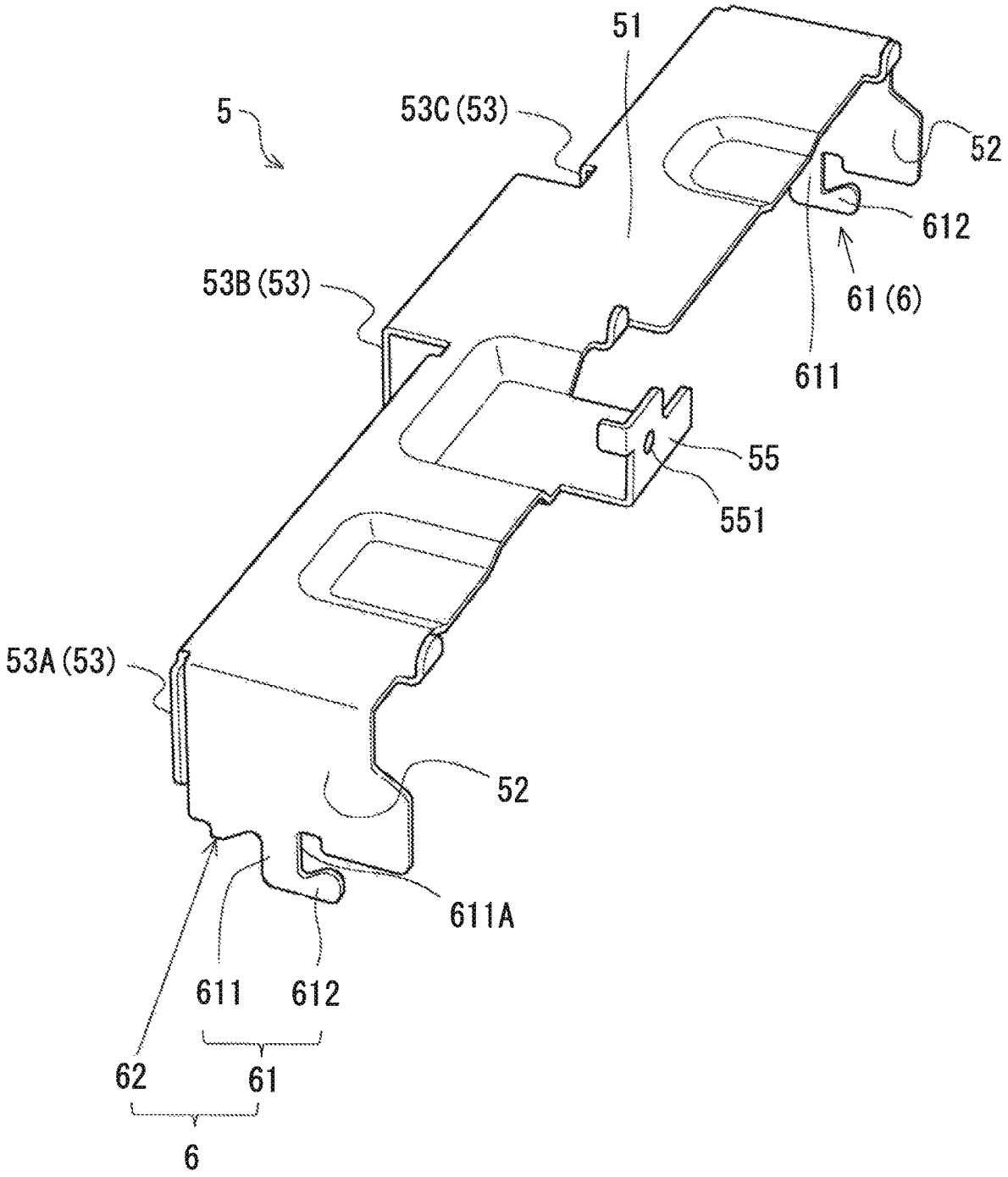
FIG. 6 is a perspective view of the connector shield according to Embodiment 1.
Figure 7:
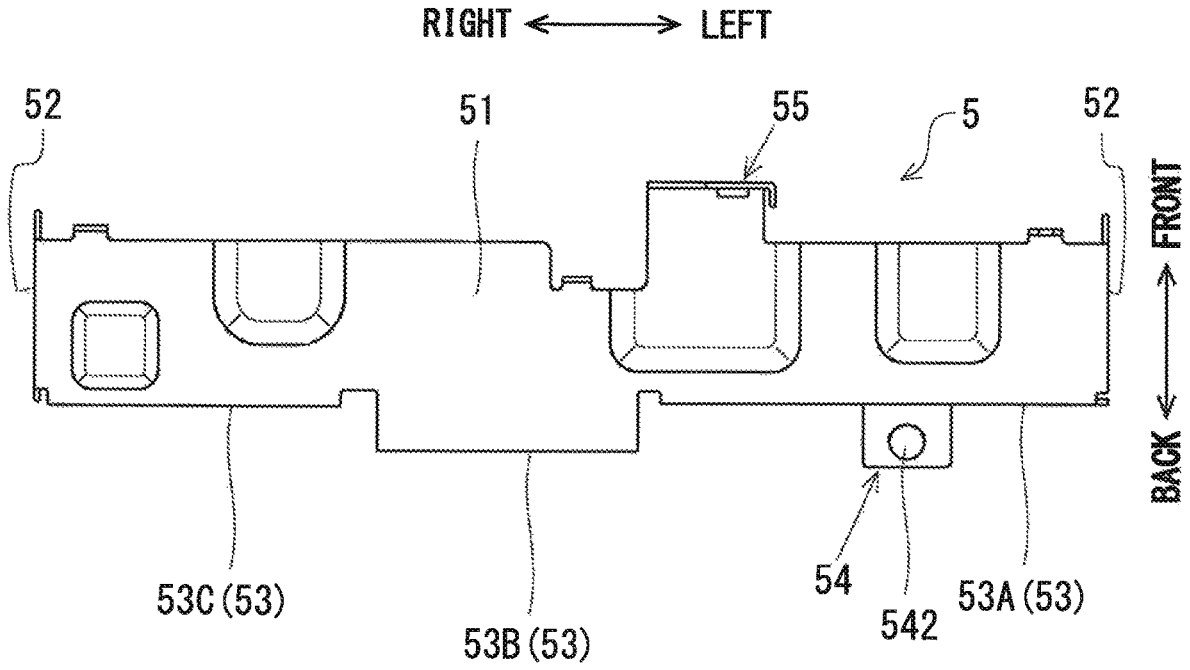
FIG. 7 is a top view of the connector shield according to Embodiment 1.
Figure 8:
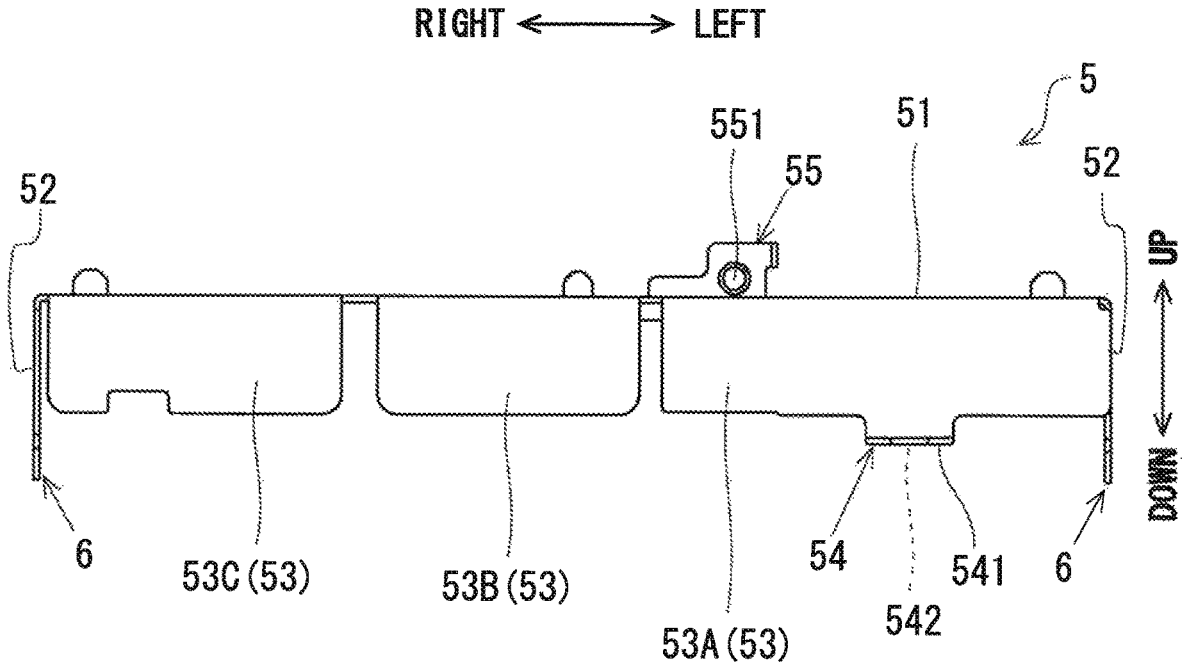
FIG. 8 is a back view of the connector shield according to Embodiment 1.
Figure 9:
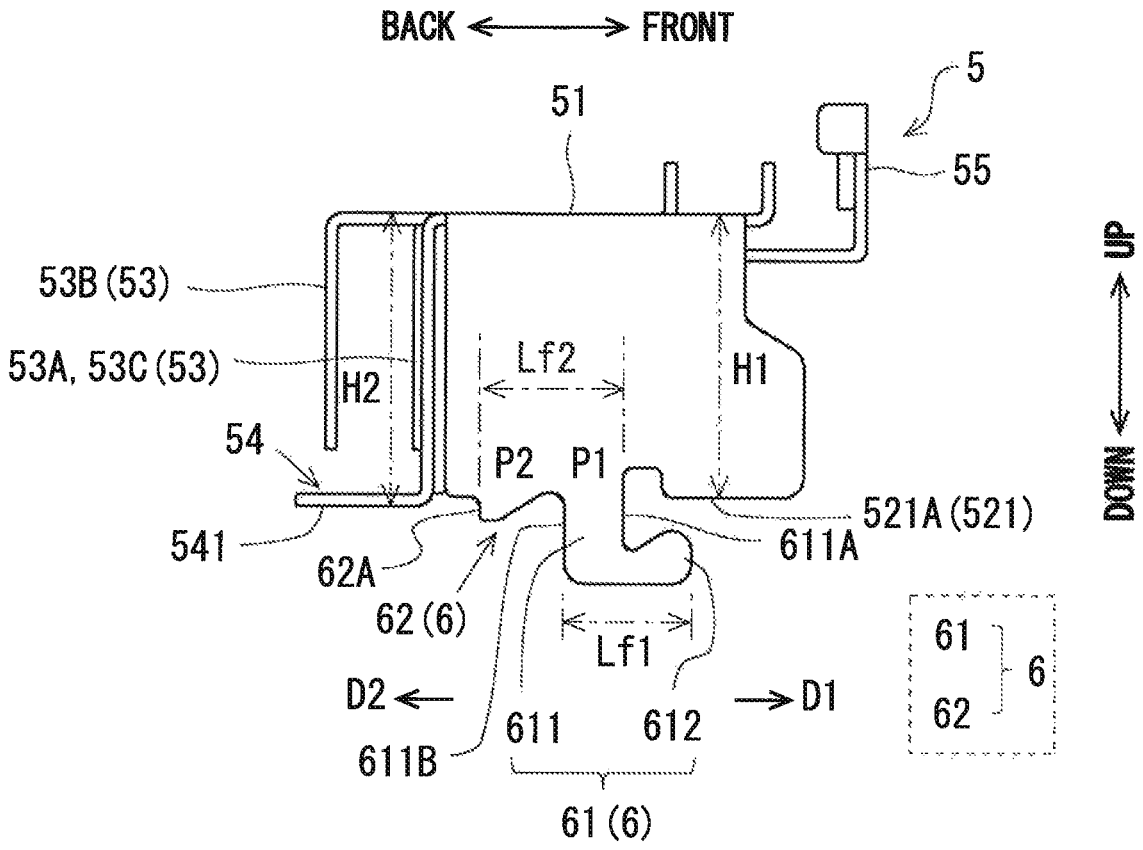
FIG. 9 is a left side view of the connector shield according to Embodiment 1.
Figure 10:
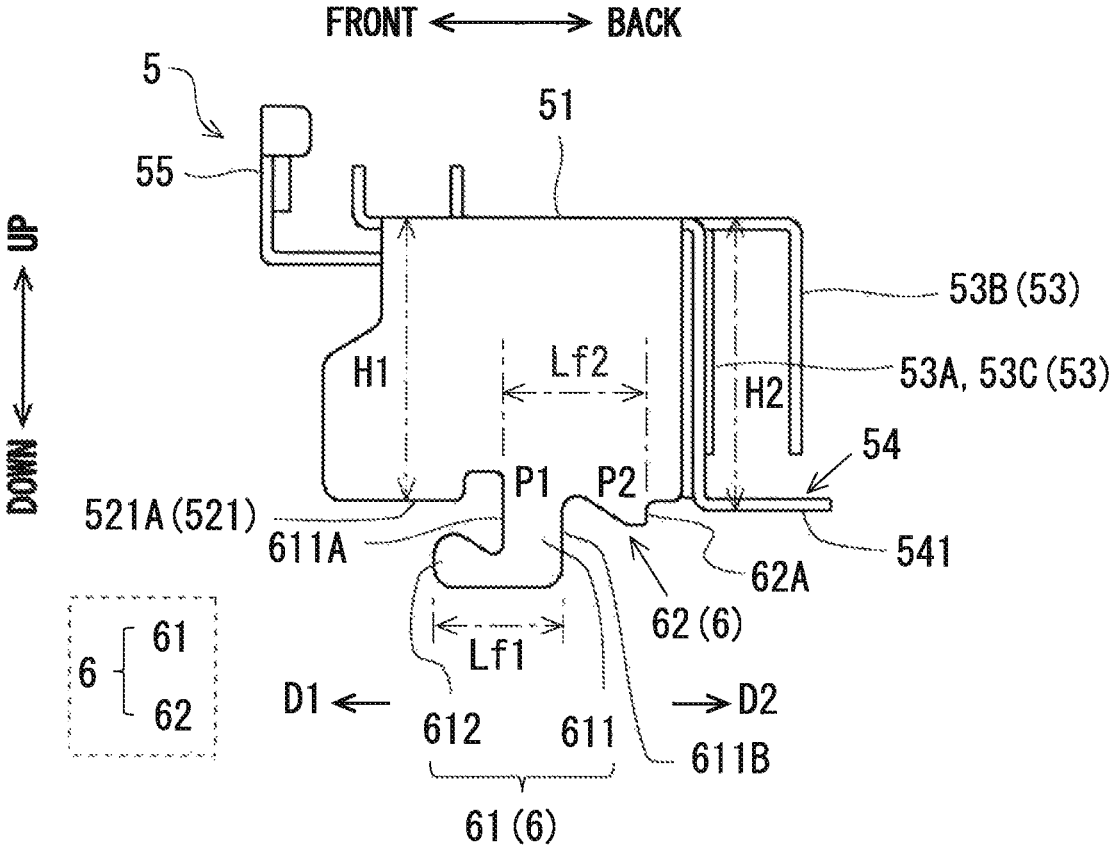
FIG. 10 is a right side view of the connector shield according to Embodiment 1.

FIG. 6 to FIG. 10 are external views of the connector shield 5 according to Embodiment 1. FIG. 6 is a perspective view of the connector shield 5 according to Embodiment 1. FIG. 7 is a top view of the connector shield 5 according to Embodiment 1. FIG. 8 is a back view (a rear view) of the connector shield 5 according to Embodiment 1. FIG. 9 is a left side view of the connector shield 5 according to Embodiment 1. FIG. 10 is a right side view of the connector shield 5 according to Embodiment 1.

The connector shield 5 is formed, for example, by pressing and bending of a plate material made of a metal. Note that the connector shield 5 may be formed by bonding a plurality of metal-made plate materials. A detailed structure will be described later, and the connector shield 5 includes an upper plate 51 to cover the upper wall 31 (the upper surface) of the connector 3, a pair of side plates 52 to cover the side walls 33 of the connector 3, a rear plate 53 to cover the rear wall 34 of the connector 3 and others. Furthermore, as illustrated in FIG. 6, the connector shield 5 has a U-shape in front view, and the pair of side plates 52 are provided in a hanging manner downwardly from opposite ends of the upper plate 51 having an almost rectangular shape in a width direction. Additionally, the rear plate 53 is provided in a hanging manner downwardly from a rear end of the upper plate 51. In addition, a front surface side of the connector shield 5 is opened to expose the port 30 of the connector 3.

In the present embodiment, the connector shield 5 is designed to collectively and electromagnetically shield the plurality of connectors 3 arranged in a row on the upper surface 2A of the wiring board 2. More specifically, the upper plate 51 in the connector shield 5 has a suitable width to collectively cover the upper walls 31 of the seven connectors 3 arranged in the row on the wiring board 2. However, a number of the connectors 3 to be mounted in the wiring board 2 is not particularly limited.

Here, among the plurality of connectors 3 (a connector group) arranged in the row on the upper surface 2A of the wiring board 2, the connectors 3 located at opposite ends in an arrangement direction (hereinafter referred to as "a connector arrangement direction") are called end connectors 3A (see FIG. 1, FIG. 5 and others). Each of the pair of side plates 52 in the connector shield 5 is configured to cover the side wall 33 disposed outward in the connector arrangement direction (hereinafter referred to as "an outer side wall 33A") in the pair of side walls 33 in each of the end connectors 3A (see FIG. 1).

As illustrated in FIG. 6, FIG. 9, FIG. 10 and others, mounting portions 6 to mount the respective side plates 52 to the wiring board 2 are provided on lower edge sides of the pair of side plates 52 in the connector shield 5. A detailed structure of the mounting portions 6 provided on the respective side plates 52 will be described later, and each of the mounting portions 6 engages with a slit through hole 20 (see FIG. 5) provided in the wiring board 2 and is thereby positioned and fixed.

The slit through hole 20 is a slit-like long hole extending through the wiring board 2, and extends along the front-back direction of the connector 3 mounted in the wiring board 2. Here, a dimension of the slit through hole 20 in an extending direction in which the hole extends along the front-back direction of the connector 3 (that can be referred to as the front-back direction of the wiring board 2) is called "a slit length dimension Ls". Furthermore, as illustrated in FIG. 5, the slit through hole 20 is disposed near the outer side wall 33A in a pair of end connectors 3A, specifically at a position slightly outer than the outer side wall 33A in the connector arrangement direction. FIG. 1 to FIG. 4 illustrate an engaged state of a pair of right and left mounting portions 6 in the connector shield 5 with the slit through holes 20 of the wiring board 2.

As described above, in a fixed state of the connector shield 5 to the wiring board 2, the upper plate 51 covers the upper walls 31 of the connectors 3 rearward from near centers of the walls, the pair of side plates 52 cover the outer side walls 33A in the end connectors 3A, and the rear plate 53 covers the rear walls 34 of the connectors 3. More specifically, the upper wall 31 of the connector shield 5 is disposed opposite to the upper surface 2A of the wiring board 2 via the connector 3. Furthermore, each of the side plates 52 of the connector shield 5 is disposed opposite to the outer side wall 33A in the end connector 3A, and the rear plate 53 is disposed opposite to the rear wall 34 of the connector 3. Note that in the present embodiment, the rear plate 53 in the connector shield 5 is formed by a first rear plate region 53A, a second rear plate region 53B, and a third rear plate region 53C that are three divided regions, but is not limited to this example.

As illustrated in FIG. 2 to FIG. 5 and others, an earth spring 4 is provided on the upper wall 31 (the upper surface) of each of the connectors 3 mounted in the wiring board 2. The earth spring 4 is a leaf spring member made of a metal that is interposed between an inner surface 511 (see FIG. 2) of the upper plate 51 in the connector shield 5 and the upper wall 31 in the connector 3. In a state where the connector shield 5 is fixed to the wiring board 2 to cover an outer surface of the connector 3, the earth spring 4 is in elastic contact with the inner surface 511 of the upper plate 51 in the connector shield 5. The earth spring 4 is formed by diagonally cutting and raising a part of the upper wall 31 in the connector 3, and extends diagonally upward and rearward from the upper wall 31 (see the earth spring 4 illustrated by a broken line in FIG. 3 and FIG. 4).

When the connector shield 5 is installed to cover the outer surface of the connector 3, the earth spring 4 is pressed downward by the inner surface 511 of the upper plate 51, and the earth spring 4 is thereby elastically deformed. As a result, electrical continuity between the earth spring 4 and the connector shield 5 is acquired. Note that in the present embodiment, there are not any restrictions as long as the earth spring 4 is interposed between the inner surface 511 of the upper plate 51 in the connector shield 5 and the upper wall 31 in the connector 3. Therefore, the earth spring 4 may be provided on a side of the inner surface 511 of the upper plate 51 in the connector shield 5.

Furthermore, as illustrated in FIG. 3, FIG. 4, FIG. 7, FIG. 8 and others, a first screw fixing portion 54 to screw the first rear plate region 53A in the rear plate 53 to the wiring board 2 is provided at a lower end of the first rear plate region 53A in the rear plate 53 of the connector shield 5. The first screw fixing portion 54 is, for example, a flat plate piece made of a metal and having a rectangular shape, and bends in a perpendicular direction from a lower edge of the first rear plate region 53A in the rear plate 53 to extend almost in parallel with the upper plate 51. In a state where the connector shield 5 is mounted to the wiring board 2, a lower surface 541 of the first screw fixing portion 54 is disposed along the upper surface 2A of the wiring board 2, and formed to abut on the upper surface 2A.

Furthermore, as illustrated in FIG. 7, FIG. 8 and others, in the first screw fixing portion 54, a first screw insertion hole 542 into which a shaft of a screwing screw 71 (see FIG. 1) is insertable is formed to extend through the first screw fixing portion 54. Furthermore, as illustrated in FIG. 5, a screwing hole 21 including a screw groove into which the screw 71 inserted into the first screw insertion hole 542 can be screwed is provided in the wiring board 2. The screw 71 inserted into the first screw insertion hole 542 in the first screw fixing portion 54 is screwed into the screwing hole 21, so that the connector shield 5 is fixed to the wiring board 2, and electrical continuity between the connector shield 5 and the wiring board 2 can be acquired. Note that in the present embodiment, the first screw fixing portion 54 is disposed in the first rear plate region 53A of the rear plate 53, but the first screw fixing portion 54 may be disposed in the second rear plate region 53B or the third rear plate region 53C in the rear plate 53.

Furthermore, in the connector shield 5, a second screw fixing portion 55 is provided in a place of a front edge in the upper plate 51. In the second screw fixing portion 55, a screwing hole 551 (see FIG. 6, FIG. 8 and others) including a screw groove into which a screw (not illustrated) can be screwed is formed to extend through the second screw fixing portion 55. The second screw fixing portion 55 is, for example, a metal piece extending to bend upward from the front edge in the upper plate 51 of the connector shield 5 in a vertical direction. Then, a screw is inserted into a screw insertion hole formed in a predetermined region of a metal-made housing (not illustrated), while the screw is screwed into the screwing hole 551 in the second screw fixing portion 55. Consequently, electrical continuity between the connector shield 5 and the metal-made housing can be acquired.

Next, description will be made as to details of the mounting portions 6 provided in lower edges 521 of the pair of side plates 52 in the connector shield 5, and a mounting structure of the connector shield 5 by use of the mounting portions 6. Note that the mounting portions 6 provided in the respective side plates 52 have the same structure. Each of the mounting portions 6 includes a retainer 61 and a positioning protrusion 62. The retainer 61 includes a foot 611 protruding downward from near a center of the lower edge 521 of each of the side plates 52 in the front-back direction, and a locking hook 612 protruding forward from a tip of the foot 611. Here, reference symbol 611A denotes a front end face of the foot 611. Furthermore, reference symbol 611B denotes a rear end face of the foot 611. Additionally, reference symbol 62A denotes a rear end face of the positioning protrusion 62.

In the lower edge 521 of each side plate 52, a position at which the foot 611 of the retainer 61 protrudes is called "a first position P1", and a position at which the positioning protrusion 62 protrudes is called "a second position P2". Furthermore, in the front-back direction of each of the side plates 52, a direction in which the locking hook 612 protrudes from the foot 611 of the retainer 61 is called "a first direction D1", and an opposite direction to this direction is called "a second direction D2". In the present embodiment, a front side in the side plate 52 corresponds to "the first direction D1", and a rear side in the side plate 52 corresponds to "the second direction D2".

The positioning protrusion 62 in the mounting portion 6 protrudes downward from the second position P2 shifted from the first position P1 at which the foot 611 of the retainer 61 protrudes downward, in the second direction D2 (a direction opposite to the direction in which the locking hook 612 protrudes from the foot 611), in the lower edge 521 of each of the side plates 52. Specifically, the locking hook 612 protrudes forward from the foot 611 of the retainer 61, and the positioning protrusion 62 is provided at a position on a rear side of the foot 611 in the side plate 52.

Reference symbol Lf1 illustrated in FIG. 9 and FIG. 10 denotes a length dimension along which the retainer 61 extends in the front-back direction of the side plate 52, and will be hereinafter called "a first length dimension Lf1". Furthermore, reference symbol Lf2 denotes a length dimension from the front end face 611A of the foot 611 in the mounting portion 6 to the rear end face 62A of the positioning protrusion 62 along the front-back direction of the side plate 52, and will be hereinafter called "a second length dimension Lf2". Here, the first length dimension Lf1 is smaller than the slit length dimension Ls in the slit through hole 20. Consequently, the retainer 61 in the mounting portion 6 can be easily inserted into the slit through hole 20.

Furthermore, it is designed that the second length dimension Lf2 is slightly smaller than the slit length dimension Ls in the slit through hole 20. Consequently, when the retainer 61 and the positioning protrusion 62 in the mounting portion 6 are inserted into the slit through hole 20, the front end face 611A of the foot 611 is engaged with (abuts on) a front end hole wall surface 20A of the slit through hole 20, and a rear end face 62A of the positioning protrusion 62 can be engaged with (abut on) a rear end hole wall surface 20B of the slit through hole 20. As a result, the mounting portion 6 is positioned in the slit through hole 20 in the front-back direction, and slide movement of the retainer 61 in the extending direction of the slit through hole 20 is regulated. Note that reference dimensions of both the dimensions and a dimensional tolerance thereof are preferably designed to prevent the second length dimension Lf2 from being larger than the slit length dimension Ls, even if manufacturing error is generated in dimension of each part during manufacturing of the connector shield 5. For example, in case where the reference dimensions of the second length dimension Lf2 and the slit length dimension Ls are 6 mm, a maximum allowable dimension may be 6.0 mm and a minimum allowable dimension may be 5.9 mm in the second length dimension Lf2, and a maximum allowable dimension may be 6.2 mm and a minimum allowable dimension may be 6.1 mm in the slit length dimension Ls. Consequently, when the mounting portion 6 of the connector shield 5 is mounted to the slit through hole 20, the positioning protrusion 62 can be easily inserted into the slit through hole 20.

Reference symbol 521A in FIG. 9 and FIG. 10 denotes "a first lower edge region" in the lower edge 521 of the side plate 52. The first lower edge region 521A is a region located in the lower edge 521 of the side plate 52 in the first direction D1 from the first position P1 at which the foot 611 protrudes. Here, a dimension of the side plate 52 in a height direction from the upper plate 51 to the first lower edge region 521A is defined as "a first height dimension H1". Furthermore, a dimension of the first screw fixing portion 54 in a height direction from the upper plate 51 to the lower surface 541 is defined as "a second height dimension H2". In the present embodiment, the first height dimension H1 is smaller than the second height dimension H2 (see FIG. 9 and FIG. 10).

Figure 11A:
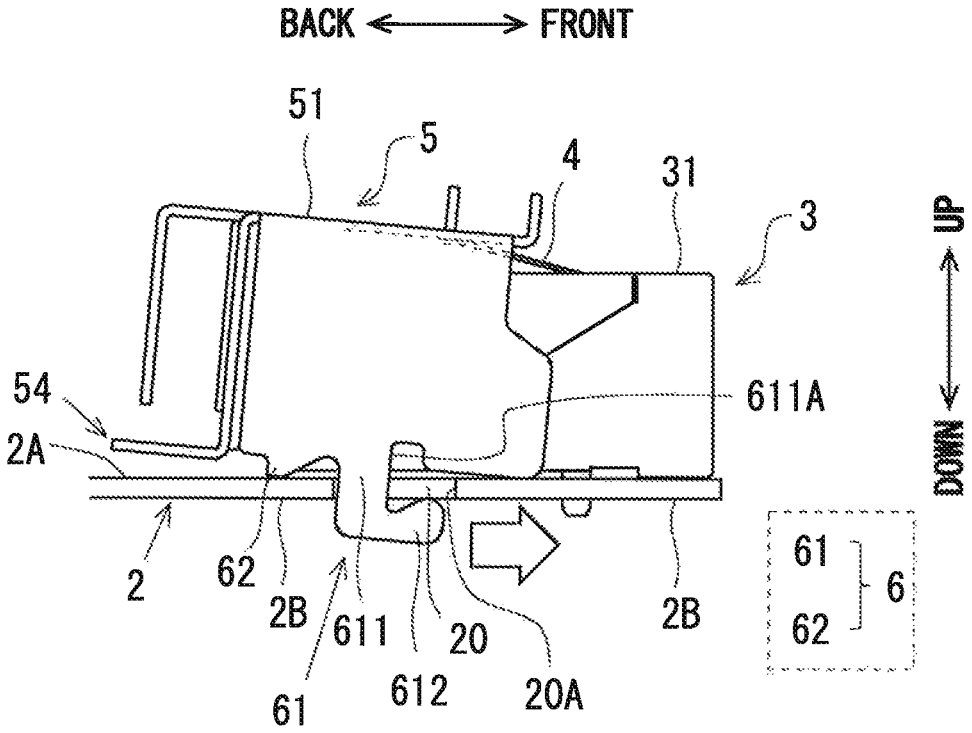
FIG. 11A is an explanatory view of a mounting method of the connector shield to the wiring board according to Embodiment 1.
Figure 11B:
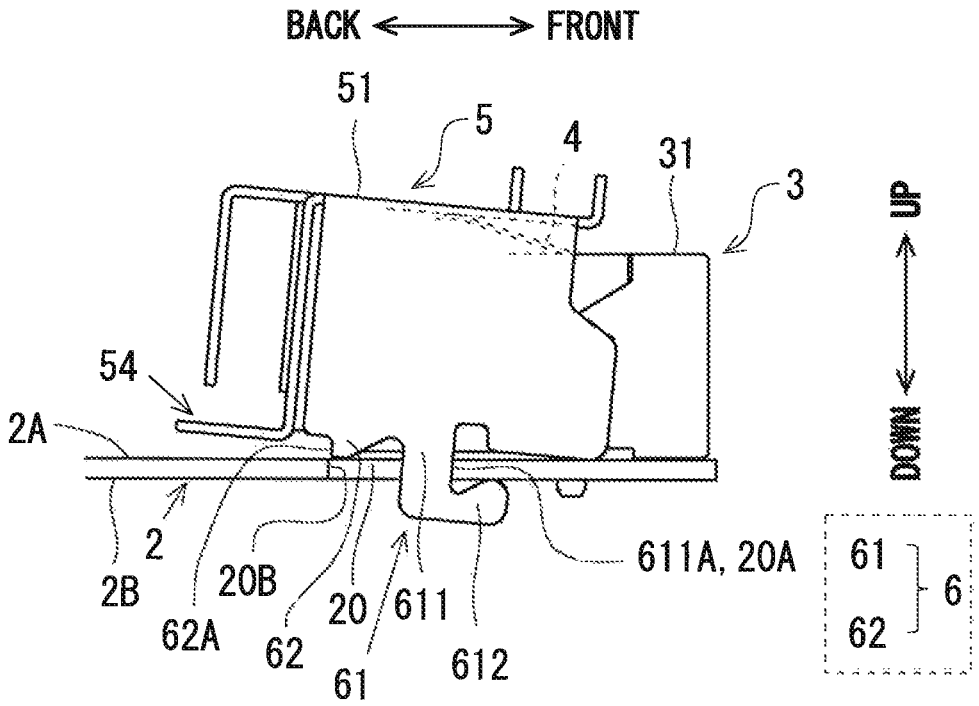
FIG. 11B is an explanatory view of the mounting method of the connector shield to the wiring board according to Embodiment 1.
Figure 11C:
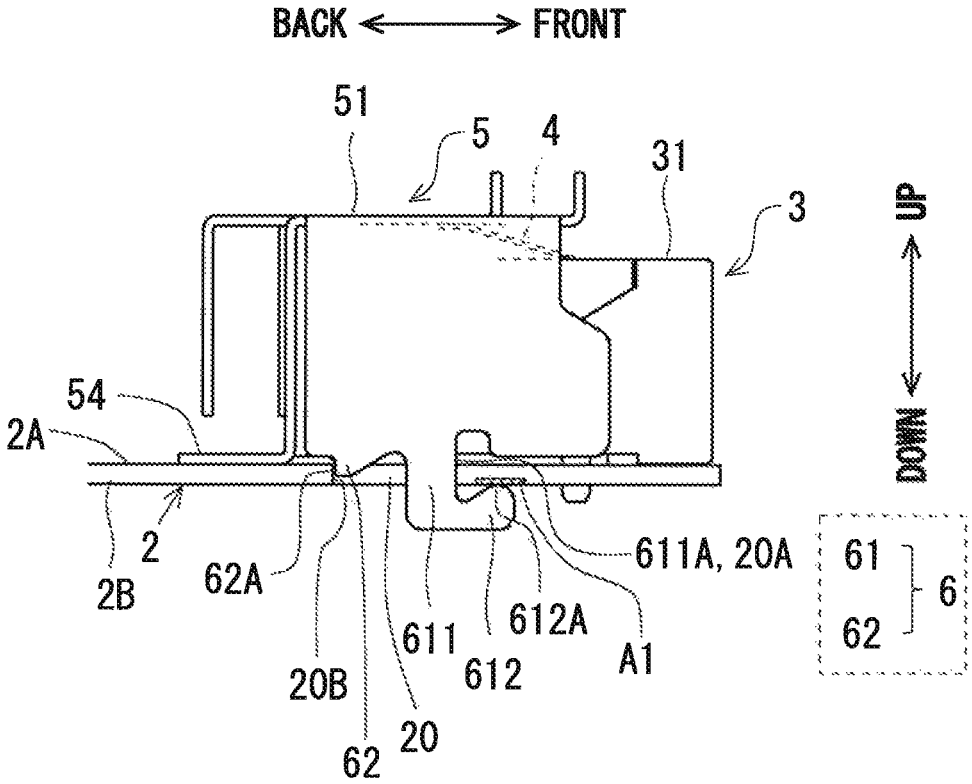
FIG. 11C is an explanatory view of the mounting method of the connector shield to the wiring board according to Embodiment 1.

FIG. 11A to FIG. 11C are explanatory views of a mounting method of the connector shield 5 to the wiring board 2 according to Embodiment 1. Hereinafter, a procedure of mounting (attaching) the connector shield 5 to the wiring board 2 by use of the mounting portion 6 will be described in detail. Note that FIG. 11A to FIG. 11C omit drawing of the second screw fixing portion 55 in the connector shield 5 for convenience.

(First Step)

In case of mounting the connector shield 5 to the wiring board 2, first, as illustrated in FIG. 11A, the retainer 61 of the mounting portion 6 provided in each of the side plates 52 is inserted into the slit through hole 20 of the wiring board 2. Since the first length dimension Lf1 along which the retainer 61 extends in the front-back direction is smaller than the slit length dimension Ls in the slit through hole 20, the retainer 61 in the mounting portion 6 can be easily inserted into the slit through hole 20 of the wiring board 2. When inserting the retainer 61 of the mounting portion 6 into the slit through hole 20, as illustrated in FIG. 11A, a front side of the connector shield 5 is brought to a posture inclined downward, thereby facilitating the insertion of the retainer 61 into the slit through hole 20.

(Second Step)

The retainer 61 of the mounting portion 6 is inserted into the slit through hole 20, and then the connector shield 5 is slid forward as illustrated in FIG. 11B. As a result, the foot 611 in the retainer 61 is slid in a direction approaching the front end hole wall surface 20A along the slit through hole 20. At this time, the foot 611 is slid along the slit through hole 20 so that the locking hook 612 of the retainer 61 slips into a side of the lower surface 2B of the wiring board 2, and the locking hook 612 is thereby locked in an edge portion of the slit through hole 20.

Here, as illustrated in FIG. 11B, when the front end face 611A of the foot 611 in the retainer 61 abuts on the front end hole wall surface 20A of the slit through hole 20, further slide movement of the foot 611 is regulated. In this way, an abutment state of the front end face 611A of the foot 611 in the retainer 61 on the front end hole wall surface 20A of the slit through hole 20 is referred to as "a first positioned state". Note that in the first positioned state, the positioning protrusion 62 in the mounting portion 6 is not inserted into the slit through hole 20 yet.

Furthermore, in the present embodiment, the first height dimension H1 is set to a dimension that is smaller than the second height dimension H2. Consequently, if a board thickness of the wiring board 2 is slightly larger than a designed dimension due to manufacturing errors, the first lower edge region 521A in the side plate 52 does not interfere with the upper surface 2A of the wiring board 2, and the foot 611 of the retainer 61 can be smoothly slid along the slit through hole 20.

Additionally, in the present embodiment, the earth spring 4 is disposed on the upper wall 31 of the connector 3, and hence a rear side of the connector shield 5 is raised upward by an elastic force (an urging force) of the earth spring 4, while on the other hand, a front side of the connector shield 5 may be noticeably inclined downward. Also in this case, a front end of the first lower edge region 521A in the side plate 52 functions as a stopper, and the front end of the first lower edge region 521A abuts on the upper surface 2A of the wiring board 2, so that the posture of the connector shield 5 can be inhibited from being excessively inclined.

(Third Step)

Furthermore, in the present embodiment, the second length dimension Lf2 is equal to the slit length dimension Ls in the slit through hole 20. Consequently, in the first positioned state illustrated in FIG. 11B, the rear end face 62A of the positioning protrusion 62 is located directly above the rear end hole wall surface 20B of the slit through hole 20. Therefore, the rear side of the connector shield 5 is depressed downward against a spring force of the earth spring 4, to insert the positioning protrusion 62 in the mounting portion 6 into the slit through hole 20 as illustrated in FIG. 11C.

Thus, when the positioning protrusion 62 in the mounting portion 6 is inserted into the slit through hole 20, the locking hook 612 in the retainer 61 is locked in the edge portion of the slit through hole 20 (specifically, the lower surface 2B forming the edge portion of the slit through hole 20), and in this state, the positioning protrusion 62 and the foot 611 inserted into the slit through hole 20 engage with the hole wall surface of the slit through hole 20. That is, the front end face 611A of the foot 611 engages with (abuts on) the front end hole wall surface 20A of the slit through hole 20, and the rear end face 62A of the positioning protrusion 62 engages with (abuts on) the rear end hole wall surface 20B of the slit through hole 20. Consequently, the sliding of the retainer 61 along the extending direction (a longitudinal direction) of the slit through hole 20 can be regulated. Furthermore, the locking of the locking hook 612 in the retainer 61 with the edge portion of the slit through hole 20 can regulate coming-off of the retainer 61 from the slit through hole 20. From the above, as a result of the regulation of movement of the mounting portion 6 in the extending direction (the longitudinal direction) of the slit through hole 20 and in a coming-off direction, the mounting portion 6 positioned in the slit through hole 20 can be fixed against a repulsive force of the earth spring 4 that acts in a direction to raise the upper plate 51 of the connector shield 5 (hereinafter, this state will be referred to as "a positioning fixed state"). Note that reference symbol 612A illustrated in FIG. 11C denotes a board abutment of the locking hook 612 in the retainer 61. The board abutment 612A of the locking hook 612 is a portion that abuts on the lower surface 2B of the wiring board 2 in the positioning fixed state of the connector shield 5. A hatched region denoted with reference symbol A1 illustrated in FIG. 11 is a hook abutment region that abuts on the board abutment 612A in the locking hook 612 of the connector shield 5 in the positioning fixed state in the lower surface 2B of the wiring board 2. For example, the hook abutment region A1 in the lower surface 2B of the wiring board 2 is not coated with resist, and a copper foil may be exposed. This can acquire electrical continuity between the board abutment 612A in the locking hook 612 and the hook abutment region A1 in the wiring board 2, and can enhance the electrical continuity between the connector shield 5 and the wiring board 2.

Furthermore, in the above positioning fixed state, the locking hook 612 of the retainer 61 can be kept in a pressed state to the lower surface 2B of the wiring board 2 by use of the repulsive force of the earth spring 4. This can inhibit the connector shield 5 from being rattled, if a gap is provided between the first lower edge region 521A in the side plate 52 and the upper surface 2A of the wiring board 2. This can hold the connector shield 5 in a posture of the upper plate 51 of the connector shield 5 disposed in parallel with the upper surface 2A of the wiring board 2.

As above, according to the mounting structure of the connector shield 5, the connector shield 5 can be easily mounted (attached) to the wiring board 2. Furthermore, after the attaching of the connector shield 5 to the wiring board 2 is completed, the first screw fixing portion 54 provided in the rear plate 53 of the connector shield 5 is screwed to the wiring board 2. As a result, the connector shield 5 can be completely fixed to the wiring board 2, and the electrical continuity between the connector shield 5 and the wiring board 2 can be acquired. Note that the attaching of the connector shield 5 to the wiring board 2 by use of the mounting portion 6 can be called temporary fixing of the connector shield 5 to the wiring board 2.

According to the mounting structure of the connector shield 5 in the present embodiment, in an attached (temporarily fixed) state of the connector shield 5 to the wiring board 2, the locking hook 612 of the retainer 61 is locked in the edge portion of the slit through hole 20 (the lower surface 2B of the wiring board 2). Consequently, when screwing the connector shield 5 to the wiring board 2, the connector shield 5 does not have to be pressed onto the wiring board 2 by use of a jig. Therefore, a number of steps in manufacturing electronic equipment can be decreased. Furthermore, the connector shield 5 can be inhibited from being raised from the wiring board 2 without pressing the connector shield 5 onto the wiring board 2 by use of the jig as described above, and hence a step of attaching the connector shield 5 to the wiring board 2 can be separated from a screw step. Consequently, a degree of freedom in manufacturing steps of manufacturing the electronic equipment can increase.

Furthermore, according to the mounting structure of the connector shield 5 in the present embodiment, the side plate 52 in the connector shield 5 does not have to be screwed to the wiring board 2, and hence operability in fixing the connector shield 5 to the wiring board 2 is extremely excellent. Additionally, only with one screw position to the wiring board 2, the electrical continuity between the connector shield 5 and the connector 3 can be acquired while inhibiting the connector shield 5 from being raised from the wiring board 2. Furthermore, for example, even in a situation where any space for screwing to the side of the end connector 3 cannot be acquired as in case where a large number of connectors 3 are arranged in a row on the wiring board 2, the connector shield 5 can be suitably fixed to the wiring board 2.

Note that in the present embodiment, the example is described in which the plurality of connectors 3 arranged in the row on the upper surface 2A of the wiring board 2 are electromagnetically shielded as a group with the connector shield 5, but this is not restrictive. For example, the connector shield 5 may singly cover a single connector 3 for the electromagnetic shielding. In this case, the upper plate 51 in the connector shield 5 may be disposed to cover the upper walls 31 in specific connectors 3, and the pair of side plates 52 may be arranged to cover the respective side walls 33 in the specific connectors 3. However, in case where the plurality of connectors 3 are arranged in the row on the upper surface 2A of the wiring board 2, there is easily a situation where the space for screwing to the side of the end connector 3 as described above cannot be sufficiently acquired. Consequently, under such conditions, the mounting structure of the connector shield 5 according to the present embodiment is applied, so that the above described technical effects are further remarkably obtainable.

Embodiment 2

Figure 12:
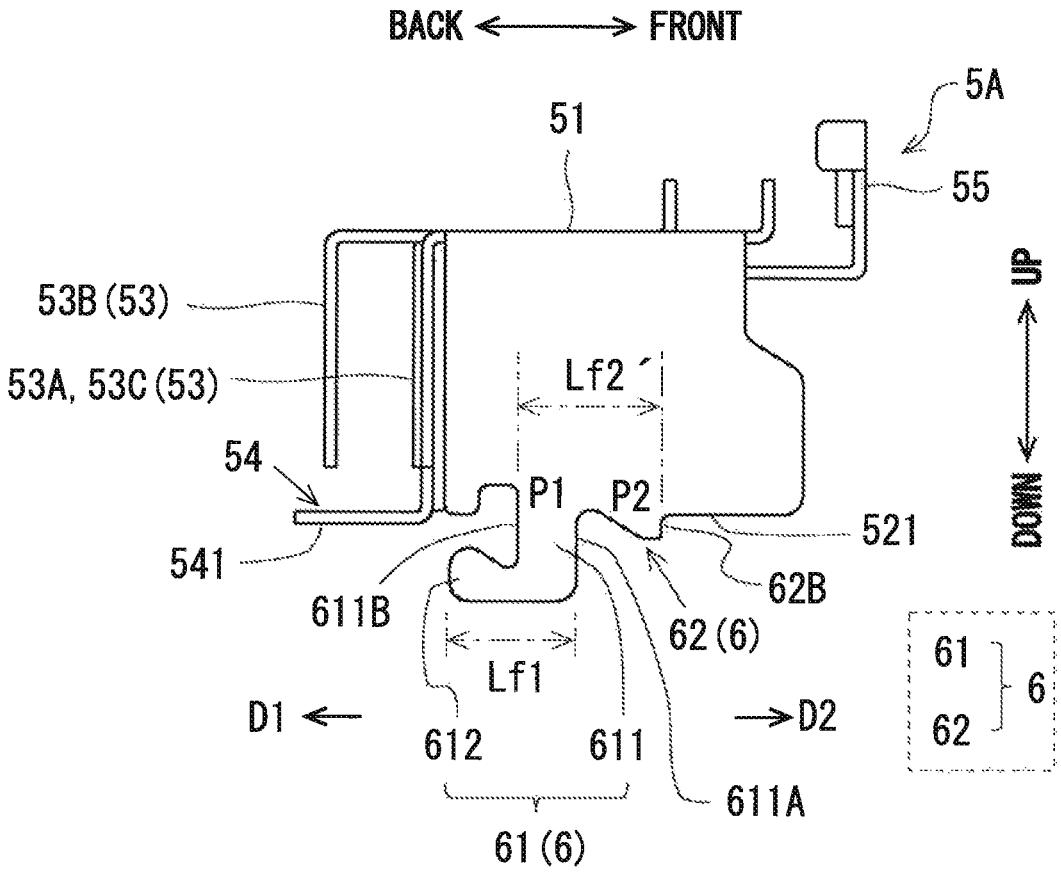
FIG. 12 is a left side view of a connector shield according to Embodiment 2.
Figure 13:
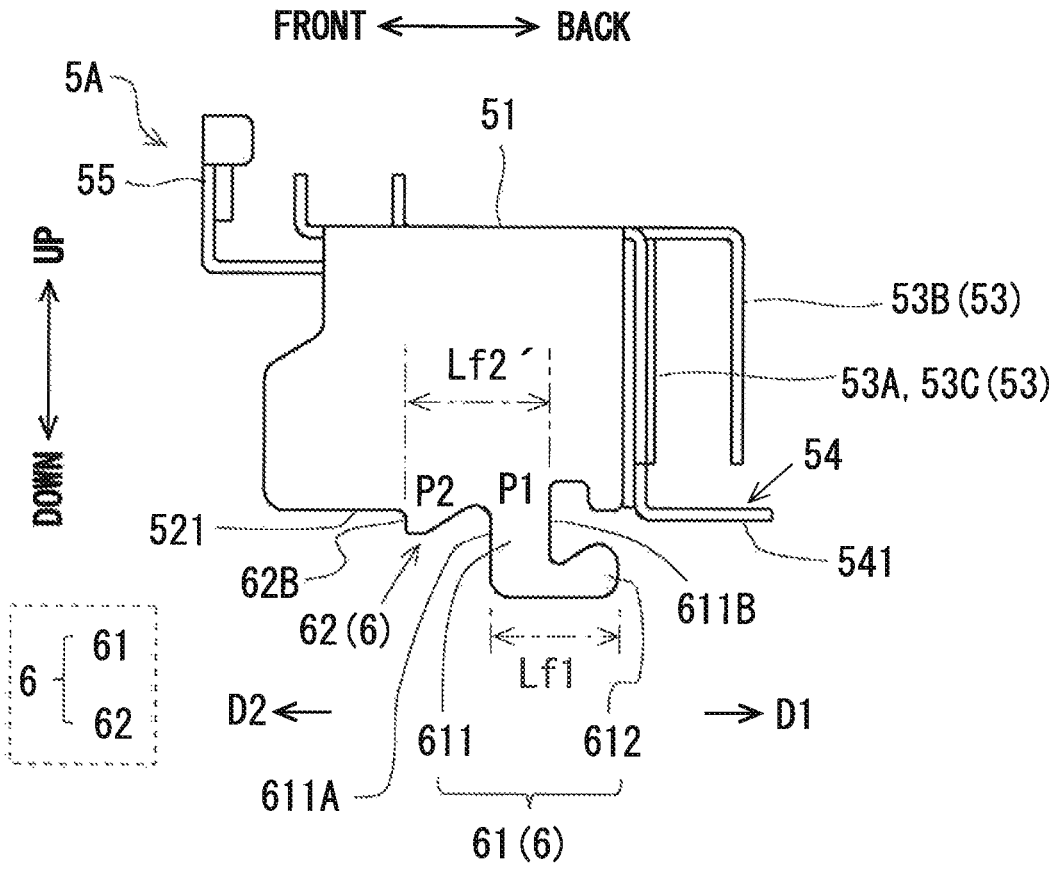
FIG. 13 is a right side view of the connector shield according to Embodiment 2.

Next, a connector shield 5A according to Embodiment 2 will be described. The connector shield 5A according to Embodiment 2 is different from the connector shield 5 according to Embodiment 1 only in a positional relation between a retainer 61 and a positioning protrusion 62 in a mounting portion 6 provided at a lower edge 521 of each of side plates 52. Hereinafter, as to the connector shield 5A according to Embodiment 2, differences from the connector shield 5 according to Embodiment 1 will be mainly described. FIG. 12 is a left side view of the connector shield 5A according to Embodiment 2. FIG. 13 is a right side view of the connector shield 5A according to Embodiment 2. In FIG. 12 and FIG. 13, the same configuration as in the connector shield 5 according to Embodiment 1 is denoted with the same reference numerals and symbols and detailed description is omitted.

As illustrated in FIG. 12 and FIG. 13, in the connector shield 5A according to Embodiment 2, an anteroposterior relation between the retainer 61 and the positioning protrusion 62 in the retainer 61 in the lower edge 521 of each of the side plates 52 changes from that in the connector shield 5 of Embodiment 1. That is, in the lower edge 521 of the side plate 52, the retainer 61 is disposed on a rear side of the positioning protrusion 62. Furthermore, as illustrated in FIG. 12 and FIG. 13, a foot 611 of the retainer 61 protrudes downward from a first position P1 in the lower edge 521 of the side plate 52, and a locking hook 612 protrudes from a lower end of the foot 611 in a first direction D1. In the connector shield 5A according to Embodiment 2, the first direction D1 corresponds to a rear side in the side plate 52, and the locking hook 612 of the retainer 61 protrudes rearward from the lower end of the foot 611. Additionally, in the lower edge 521 of the side plate 52, the positioning protrusion 62 protrudes downward from a second position P2 shifted from the first position P1 at which the foot 611 of the retainer 61 protrudes, in a second direction D2 (corresponding to a front side in the side plate 52 in the present embodiment). Note that reference symbol 62B denotes a front end face of the positioning protrusion 62.

Here, reference symbol Lf1 illustrated in FIG. 12 and FIG. 13 denotes "a first length dimension" along which the retainer 61 extends in a front-back direction of the side plate 52 in the same manner as in Embodiment 1. Reference symbol Lf2' denotes "a second length dimension" along the front-back direction of the side plate 52 from a rear end face 611B of the foot 611 to the front end face 62B of the positioning protrusion 62 in a mounting portion 6. Also in Embodiment 2, the first length dimension Lf1 is smaller than a slit length dimension Ls in a slit through hole 20 (see FIG. 5) formed in a wiring board 2 in the same manner as in Embodiment 1. Consequently, the retainer 61 in the mounting portion 6 can be inserted into the slit through hole 20 of the wiring board 2. Furthermore, the second length dimension Lf2' is equal to the slit length dimension Ls in the slit through hole 20.

As to the connector shield 5A configured as above, the retainer 61 and the positioning protrusion 62 in the mounting portion 6 are inserted into and engaged with the slit through hole 20 of the wiring board 2 by a procedure basically similar to that for the connector shield 5 according to Embodiment 1, so that the connector shield 5A can be mounted to the wiring board 2.

That is, the retainer 61 in the mounting portion 6 for the connector shield 5A is inserted into the slit through hole 20 of the wiring board 2, and then the connector shield 5A is slid so that the locking hook 612 of the retainer 61 slips into a side of a lower surface 2B of the wiring board 2. At this time, in the present embodiment, the connector shield 5 is slid rearward, to slide the foot 611 in the retainer 61 in a direction approaching a rear end hole wall surface 20B along the slit through hole 20. Thereafter, the rear end face 611B of the foot 611 abuts on the rear end hole wall surface 20B (see FIG. 5) of the slit through hole 20, and at this time, the positioning protrusion 62 in the mounting portion 6 is inserted into the slit through hole 20. Here, in the connector shield 5A, since the second length dimension Lf2' is set to a dimension that is equal to the slit length dimension Ls in the slit through hole 20, a front side of the connector shield 5A is depressed downward against a spring force of an earth spring 4 from an abutment state of the rear end face 611B of the foot 611 in the retainer 61 on the rear end hole wall surface 20B of the slit through hole 20, so that the positioning protrusion 62 in the mounting portion 6 can be smoothly inserted into the slit through hole 20.

When the retainer 61 and the positioning protrusion 62 in the mounting portion 6 are inserted into the slit through hole 20 of the wiring board 2 as described above, the rear end face 611B of the foot 611 engages with (abuts on) the rear end hole wall surface 20B of the slit through hole 20, and the front end face 62B of the positioning protrusion 62 engages with (abuts on) a front end hole wall surface 20A of the slit through hole 20, so that sliding of the retainer 61 along an extending direction (a longitudinal direction) of the slit through hole 20 can be regulated. Furthermore, the locking hook 612 in the retainer 61 is locked in an edge portion of the slit through hole 20, so that coming-off of the retainer 61 from the slit through hole 20 can be regulated as well. From the above, as a result of the regulation of movement of the mounting portion 6 in the extending direction (the longitudinal direction) of the slit through hole 20 and in a coming-off direction, the mounting portion 6 can be positioned and fixed to the slit through hole 20. Eventually, effects similar to those of Embodiment 1 can be obtained also in a mounting structure of the connector shield 5A according to Embodiment 2.

As above, the embodiments of the present invention have been described, but the present invention is not limited to these embodiments, and various changes based on knowledge of a person skilled in the art are possible, for example, by combination of the above configurations without departing from a gist of Scope of Claims. For example, in the above described embodiments, an aspect has been described as an example where a pair of slit through holes 20 are arranged in the wiring board 2, and both of the retainer 61 and the positioning protrusion 62 in the mounting portion 6 are collectively inserted into each of the slit through holes 20, but this example is not restrictive. For example, in each slit through hole 20, a first region into which the retainer 61 of the mounting portion 6 is inserted and a second region into which the positioning protrusion 62 is inserted may be individually and independently provided.

DESCRIPTION OF THE REFERENCE NUMERALS AND SYMBOLS

1 mounting structure of a connector shield
2 wiring board
3 connector
4 earth spring
5 connector shield
6 mounting portion
20 slit through hole
31 upper wall
32 lower wall
33 side wall
34 rear wall
51 upper plate
52 side plate
53 rear plate
61 retainer
62 positioning protrusion
611 foot
612 locking hook

The invention claimed is:

1. A mounting structure of a connector shield mounted on a wiring board and configured to cover a connector including a port for a mating connector in a front surface of the connector, wherein:

the connector shield comprises:

an upper plate that covers an upper surface of the connector, a pair of side plates that (i) cover side surfaces of the connector and (ii) extend downward from opposite side ends of the upper plate, a mounting portion, provided on a lower edge side of each of the pair of side plates, to mount each side plate to the wiring board, a rear plate that covers a rear surface of the connector, and a screw fixing portion provided on the rear plate and screwed to the wiring board;

the wiring board includes slit through holes, each of which is configured to position and fix the mounting portion of one of the pair of side plates;

an earth spring is interposed between the connector shield and the connector;

the mounting portion of each of the pair of side plates comprises:

a retainer that is insertable into a corresponding one of the slit through holes and that includes (i) a foot protruding downward from a first position of a lower edge of the side plate and (ii) a locking hook protruding forward or rearward from the foot in a first direction, and a positioning protrusion (i) that protrudes downward from a second position of the lower edge of the side plate shifted from the first position in a second direction opposite to the first direction and (ii) that is insertable into the corresponding slit through hole;

each of the mounting portions is positioned and fixed to a corresponding one of the slit through holes by way of the locking hook of that mounting portion being inserted into the corresponding slit through hole and locked in an edge portion of the corresponding slit through hole, the positioning protrusion and the foot of the inserted mounting portion being inserted into the corresponding slit through hole and engaging with a hole wall surface of the corresponding slit through hole; and in the lower edge side of each of the pair of side plates, a first height dimension from the upper plate in a first lower edge region located on a side of the first direction from the first position is smaller than a second height dimension from the upper plate to a lower surface of the screw fixing portion.

2. The mounting structure of the connector shield according to claim 1, wherein:

the connector comprises two or more connectors arranged in a row on the wiring board;

the upper plate of the connector shield has a width to collectively cover upper surfaces of the two or more of the connectors; and a pair of the side plates cover side surfaces of the connectors located at opposite ends in an arrangement direction of the two or more of the connectors.

3. A mounting structure of a connector shield mounted on a wiring board and configured to cover a connector including a port for a mating connector in a front surface of the connector, wherein:

the connector shield comprises:

an upper plate that covers an upper surface of the connector, a pair of side plates that (i) cover side surfaces of the connector and (ii) extend downward from opposite side ends of the upper plate, and a mounting portion, provided on a lower edge side of each of the pair of side plates, to mount each side plate to the wiring board, the wiring board includes slit through holes, each of which is configured to position and fix the mounting portion of one of the pair of side plates;

an earth spring is interposed between the connector shield and the connector;

the mounting portion of each of the pair of side plates comprises:

a retainer that is insertable into a corresponding one of the slit through holes and that includes (i) a foot protruding downward from a first position of a lower edge of the side plate and (ii) a locking hook protruding forward or rearward from the foot in a first direction, and a positioning protrusion (i) that protrudes downward from a second position of the lower edge of the side plate shifted from the first position in a second direction opposite to the first direction and (ii) that is insertable into the corresponding slit through hole;

each of the mounting portions is positioned and fixed to a corresponding one of the slit through holes by way of the locking hook of that mounting portion being inserted into the corresponding slit through hole and locked in an edge portion of the corresponding slit through hole, the positioning protrusion and the foot of the inserted mounting portion being inserted into the corresponding slit through hole and engaging with a hole wall surface of the corresponding slit through hole; and the positioning protrusion of each of the mounting portions (i) is configured to be restricted from being inserted into a corresponding one of the slit through holes until the locking hook of that mounting portion inserted into the corresponding slit through hole is slid in the first direction and an end surface of the foot abuts on the hole wall surface of the corresponding slit through hole and (ii) is configured to be inserted into the corresponding slit through hole after the end surface of the foot of that mounting portion abuts on the hole wall surface of the corresponding slit through hole.

* * * * *